US005160746A

United States Patent [19]

Dodge, II et al.

[11] Patent Number: 5,160,746

[45] Date of Patent: Nov. 3, 1992

[54] APPARATUS FOR FORMING A NONWOVEN WEB

[75] Inventors: Richard N. Dodge, II, Roswell; Ann L. Wagner, Cummings, both of Ga.; Larry C. Fowler, Clearwater, Fla.; Martin A. Allen, Gainesville; John T. Fetcko, III, Dawsonville, both of Ga.

[73] Assignee: Kimberly-Clark Corporation, Neenah, Wis.

[21] Appl. No.: 732,449

[22] Filed: Jul. 18, 1991

Related U.S. Application Data

[63] Continuation of Ser. No. 362,737, Jun. 7, 1989, abandoned.

[51] Int. Cl.[5] ..... B05B 7/00

[52] U.S. Cl. ..... 425/7; 156/167; 264/6; 264/12; 264/115; 425/72.2

[58] Field of Search ..... 264/6, 12, 518, 115, 264/517; 425/7, 72.2; 156/167

[56] References Cited

U.S. PATENT DOCUMENTS

| | | | |
|---|---|---|---|
| 2,522,526 | 9/1950 | Manning . | |
| 2,522,527 | 9/1950 | Manning . | |
| 2,571,457 | 10/1951 | Ladisch . | |
| 2,903,387 | 9/1959 | Wade . | |
| 2,950,752 | 8/1960 | Watson et al. . | |
| 2,988,469 | 6/1961 | Watson . | |
| 3,017,664 | 1/1962 | Ladisch . | |
| 3,528,129 | 9/1970 | Hartmann . | |
| 3,543,332 | 12/1970 | Wagner et al. . | |
| 3,588,951 | 6/1971 | Hegmann . | |
| 3,592,391 | 7/1971 | Bender et al. | 425/7 |
| 3,702,748 | 11/1972 | Stoeb et al. | 425/6 |
| 3,716,318 | 2/1972 | Erik et al. | 425/245 |
| 3,755,527 | 8/1973 | Keller et al. | 264/210 |
| 3,796,617 | 3/1974 | Wiltshire | 156/62.2 |
| 3,833,698 | 9/1974 | Wiltshire | 264/91 |
| 3,904,339 | 9/1975 | Dunn | 425/162 |
| 3,905,734 | 9/1975 | Blair | 425/224 |
| 3,911,173 | 10/1975 | Sprague, Jr. | 427/207 |
| 3,920,362 | 11/1975 | Bradt | 425/72 |
| 3,978,185 | 8/1976 | Buntin et al. . | |
| 3,985,481 | 10/1976 | Brackmann et al. | 425/723 |
| 4,031,854 | 6/1977 | Sprague, Jr. | 118/641 |
| 4,047,861 | 9/1977 | Balaz | 425/7 |
| 4,073,850 | 2/1978 | Brackmann et al. . | |
| 4,098,632 | 4/1978 | Sprague, jr. | 156/295 |
| 4,103,058 | 7/1978 | Humlicek | 428/171 |
| 4,104,340 | 8/1978 | Ward | 264/6 |
| 4,135,903 | 1/1979 | Ohsato et al. | 65/5 |
| 4,145,200 | 3/1979 | Yamazaki et al. | 65/2 |
| 4,167,548 | 9/1979 | Arduini et al. | 264/12 |

(List continued on next page.)

FOREIGN PATENT DOCUMENTS

| | | | |
|---|---|---|---|
| 0334653A2 | 9/1989 | European Pat. Off. . | |
| 496741 | 8/1954 | Italy | 425/7 |
| 1370979 | 10/1974 | United Kingdom | 425/7 |
| 1493706 | 11/1977 | United Kingdom . | |
| WO83/04040 | 11/1983 | World Int. Prop. O. . | |

OTHER PUBLICATIONS

"Application Potential of Controlled Fiberization Spray Technology" by John Bateeman–pp. 44–46, *Nonwovens Industry*, Jan. 1988.

*Primary Examiner*—Mary Lynn Theisen

[57] ABSTRACT

Disclosed herein is an apparatus of the type for forming a nonwoven web from a fiber forming thermoplastic polymer resin which includes a reservoir for supplying a quantity of melted fiber forming thermoplastic resin, a pump for pumping the molten resin to a fiber forming die, and a die for forming a discrete resin stream to flow therefrom. The die includes a first fluid passageway for forming a stream of fluid, such as air, in contact with and substantially surrounding the formed flow of resin for a predetermined distance within the die and a fluid interrupt system for selectively cycling the flow of resin on and off and clearing the resin from the fiber forming die. A receiving belt collects the fibers formed from the resin flow beyond the first fluid passageway spaced at a predetermined distance from the die.

13 Claims, 8 Drawing Sheets

U.S. PATENT DOCUMENTS

| | | | |
|---|---|---|---|
| 4,168,138 | 9/1979 | McNally | 425/66 |
| 4,173,443 | 11/1979 | Lin | 425/66 |
| 4,185,981 | 1/1980 | Ohsato et al. | 65/5 |
| 4,243,400 | 1/1981 | Ohsato et al. | 65/16 |
| 4,267,002 | 5/1981 | Sloan et al. | 156/276 |
| 4,295,809 | 10/1981 | Wikami et al. | 425/72 S |
| 4,334,637 | 6/1982 | Baker et al. | 222/146 H |
| 4,375,446 | 3/1983 | Fujii et al. | 264/518 |
| 4,377,985 | 3/1983 | Reba | 118/315 |
| 4,380,570 | 4/1983 | Schwarz | 428/296 |
| 4,468,191 | 8/1984 | Gellert | 425/564 |
| 4,478,624 | 10/1984 | Battigelli et al. | 65/4.4 |
| 4,548,632 | 10/1985 | Tamara et al. | 65/5 |
| 4,692,371 | 9/1987 | Morman et al. | 264/6 |
| 4,714,647 | 12/1987 | Shipp, Jr. et al. | 156/167 |
| 4,785,996 | 11/1988 | Ziecker et al. | 239/298 |
| 4,815,660 | 3/1989 | Boger | 239/8 |
| 4,891,249 | 1/1990 | McIntyre | 427/421 |

APPARATUS FOR FORMING A NONWOVEN WEB

This is a continuation of copending application Ser. No. 07/362,737 filed on Jun. 7, 1989, now abandoned.

TECHNICAL FIELD

The present invention relates to an apparatus for manufacturing nonwoven fabrics useful for a wide variety of applications, such as for personal care products, household cleaning materials and wipers, and the like. More specifically, the present invention provides a novel method and means for forming fibers from a fiber forming thermoplastic polymer resin.

BACKGROUND OF THE INVENTION

The manufacture of nonwoven fabrics is a highly developed art. Generally, nonwoven webs or mats are made by forming filaments or fibers of varying or specific diameter and depositing them on a carrier in such a manner so as to cause the filaments or fibers to overlap or entangle as a web of a desired basis weight.

Various means have been developed in an attempt to control the form of the processed fibers which in turn affects the properties of the formed web. For example, U.S. Pat. No. 2,571,457 to Ladisch, issued Oct. 16, 1951 discloses a spray nozzle for forming filaments and/or fibers in diameters of about one micron and smaller by passing a polymer stream through the central orifice of a nozzle with an elastic fluid such as air being caused to spiral towards the vertex of a cone. U.S. Pat. No. 3,017,664 to Ladisch, issued Jan. 23, 1962 discloses a fiber forming nozzle wherein a stream of polymer material exits a nozzle orifice in the form of a tube, formation of the tube being caused by the spreading of the polymer over the outside wall of a circular body positioned in the orifice. An elastic fluid rotating in a spiraling manner around the film of polymer with a very high velocity creates a vacuum between the film and elastic fluid. Fibers are picked up from the film of fiber forming liquid and drawn out to fineness in the elastic fluid. Although both Ladisch patents disclose a spiraling air which surrounds the resin flow from an orifice, the emitted air is transmitted through nozzle openings which do not surround the polymer stream.

U.S. Pat. No. 3,543,332 to Wagner et al, issued Dec. 1, 1970, discloses the production of fibers utilizing a spinning nozzle, the spinning nozzle having a central orifice for forming a polymer stream and additional orifices surrounding the central orifice for the passage of fiber forming air.

U.S. Pat. No. 3,755,527 to Keller et al, issued Aug. 28, 1973, discloses a process for producing meltblown nonwoven synthetic polymer mats. The meltblown process utilizes a plurality of extrusion orifices through which a melted polymer resin is extruded. On each side of the plurality of orifices is a hot air slot for supplying a stream of hot gas in the form of a sheet on each side of the plurality of fiber streams formed from the resin. To produce fibers having diameters between 10 and 40 microns, combinations of die tip temperature, resin flow rate, and resin molecular weight are selected to give an apparent viscosity in the die holes from about 10 to 800 poise. The viscosity is then adjusted into an operable range by varying the die tip temperature.

U.S. Pat. No. 3,905,734 to Blair, issued Sep. 16, 1975 discloses improvements for an apparatus for continuous tube forming by meltblowing techniques. The assembly utilizes knife-like streams of forming gas on each sideof a polymer exit orifice.

U.S. Pat. No. 3,978,185 to Buntin et al, issued Aug. 31, 1976 discloses a meltblown nonwoven mat prepared from thermoplastic polymer fibers which are alleged to be substantially completely free of polymer shot and produced at a high polymer throughput rate in a specific meltblowing process in which thermoplastic polymer resins having a specific viscosity range are degraded in the presence of a free radical source compound.

U.S. Pat. Nos. to Oshido et al, 4,135,903 issued Jan. 23, 1979 and 4,185,981 issued Jan. 29, 1980 disclose a method and apparatus for producing fibers from a heat softening material utilizing high speed gas streams which cause the melted polymer to rotate around its central axis line and transform it into a substantially conical shape whose cross-section gradually decreases towards its flowing direction in a first cone and is caused to advance in the form of fiber from the tip of the cone in the flowing direction and outwardly in the radial direction in a second cone.

It remains desirable to develop further apparatus and method for forming fibers from molten fiber forming resins and then forming mats from the formed fibers wherein the apparatus and process provide increased throughput on a per-hole basis and wider operating ranges.

The above references teach apparatus and processes which are quite capable of forming flat mats or webs of nonwoven material which are most commonly subjected to additional processing for incorporation into other products such as diapers and other personal care items or subsequent conversion into such items as disposable workwear. With the advancement of nonwoven fiber forming technology, the uses and applications for such materials have been greatly enhanced. As new uses and applications are found, the design limitations of current equipment become more evident. With the increasing costs of the polymers used in the formation of fibers, overall production costs become an ever important factor. One way to reduce the cost of the nonwoven material is to increase the production capability of the equipment. Unfortunately, with current meltblowing equipment, there are severe limitations as to the amount of polymer throughput which can be tolerated by the meltblowing dies. As polymer viscosities and pressures increase, so does the likelihood of the dies, themselves, fracturing or "zippering" as it is known in the industry. It is therefore an object of the present invention to provide an apparatus and process which allow for substantially higher polymer pressures and thus higher throughputs on a per-hole basis relative to normal meltblown die tip construction.

Another major problem in the formation of nonwoven fibers and the resultant webs is a phenomenon called "shot". Shot occurs when drawing air is improperly applied to the extruded polymer stream. When this condition occurs, small beads of polymer are formed along with the fibers, thereby giving the formed web a very rough feel. This can be caused by equipment design, improper adjustment of the air to polymer ratio, processing conditions, or a combination of the three. In almost all applications, shot is not desirable. It is therefore an object of the present invention to provide a process and apparatus with increased air flow to and around the extruded polymer, when desired, to decrease shot, and increase fiber formation efficiency or reverse the process when necessary.

As the demands upon nonwoven materials become more complex, it is sometimes desirable to form nonwoven materials which are comprised of intimately entangled fibers of different polymer composition and/or fiber size. The actual generation of materials using more than one polymer and/or fiber typically requires production in a multi-bank layered setup wherein one bank of dies forms fibers of one size or polymer, while another set of dies produces fibers of another size or polymer. It is therefore an object of the present invention to provide an apparatus and process which will permit the formation of multi-component nonwoven materials in a more localized and efficient manner.

Another drawback with current meltblowing apparatus and processes are their inability to produce nonwoven materials which are three-dimensional in structure and/or zoned in density in either or both the machine and cross directions. A primary reason for this is the fact that the meltblowing equipment as described above is planar in design and must operate on a continuous basis due to the heating requirements of the polymer and the problem with die holes plugging with stagnant polymer. Consequently, such equipment cannot be cycled on and off to create nonwoven materials having varying densities and other attributes. It is therefore an object of the present invention to provide an apparatus and process which will allow cyclical release of polymer during the fiber forming process.

With current meltblowing equipment, production runs are made at a specified width which usually corresponds to the width of the bank of meltblown die tips or openings. To change widths, holes must be plugged or the system shut down to refit the line with smaller or larger banks of die tips. It is therefore an object of the present invention to provide an apparatus and process which allow on-line variations in production widths of the nonwoven material. Lastly, current meltblowing equipment often becomes clogged when the small die openings become filled with solidified polymer. Usually, there is very little that can be done to unclog the holes while the machinery is running. While a few clogged holes will usually not affect production quality, once enough of the holes become clogged, the die tip must be taken off-line and cleaned—a costly and time-consuming process. It is therefore yet another object of the present invention to provide a process and apparatus which is self-cleaning.

These and other objects and advantages of the present invention will become more apparent upon a further review of the following specification, drawings and claims.

SUMMARY OF THE INVENTION

In accordance with the present invention there is provided a process and apparatus of the type for forming a nonwoven web from a fiber forming thermoplastic polymer resin, the apparatus including reservoir means for supplying a quantity of melted fiber forming thermoplastic polymer resin and pump means for pumping the resin from the reservoir means to a fiber forming die. Die means forms a discrete flow of resin which is pumped from the reservoir means. The die means includes fiberization means for forming fibers from the flow of resin utilizing first fluid passage means for forming a stream of fluid, such as air, which contacts and substantially surrounds the formed flow of resin for a predetermined distance within the die means. The fiberization means may further include a second fluid passage means for further contacting and attenuating the formed fibers. Receiver means spaced at an adjustable predetermined distance from the die means collects the fibers formed from the fluid passage means, thereby forming the nonwoven web. A hydraulically actuated stem within the die means provides an on/off control for selectively stopping flow of the fiber forming resin. The stem may be further used to dislodge resinous debris from the die means.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
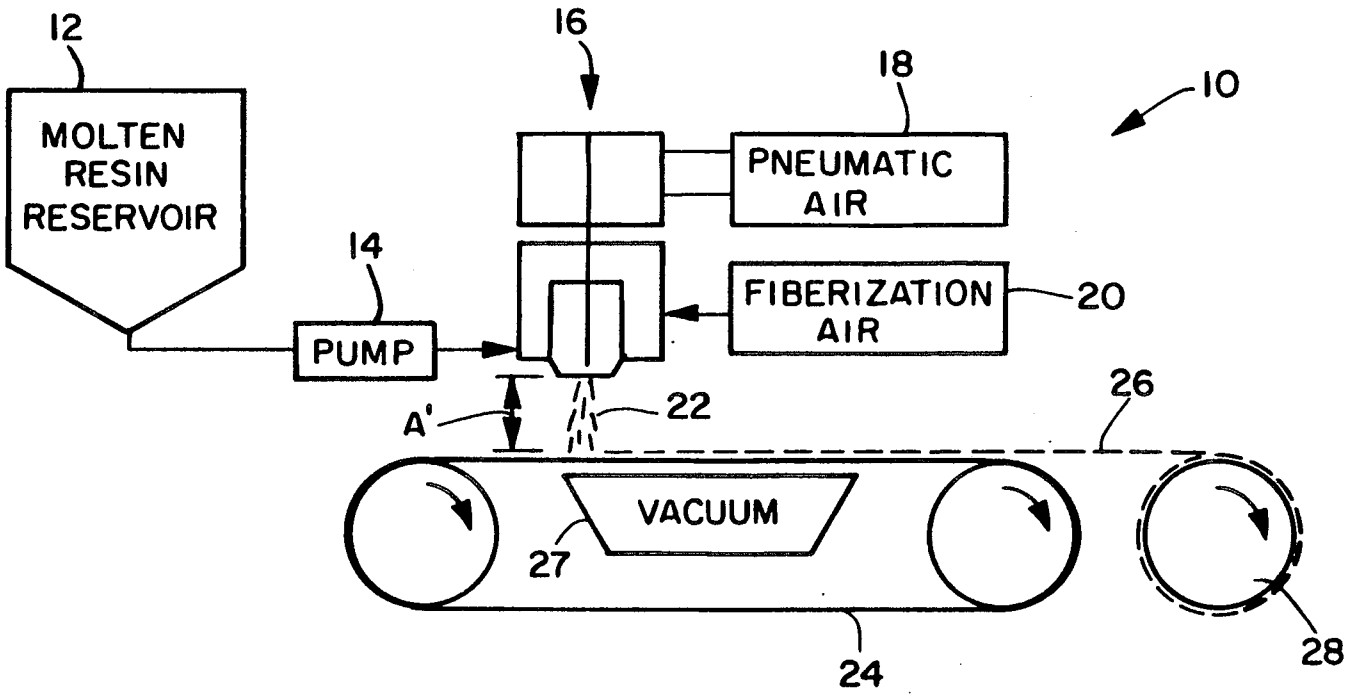
FIG. 1 is a schematic illustration of an apparatus constructed in accordance with the present invention.

An apparatus of the type for forming a nonwoven web from a fiber forming thermoplastic polymer resin is shown schematically at 10 in FIG. 1. Generally, the apparatus includes a reservoir 12 for supplying a quantity of melted fiber forming thermoplastic polymer resin. Such resins are well known in the art. Examples of such resins which can be used in the practice of the present invention include but are not limited to polypropylene, polyethylene, polyester, polyetherester copolymer, polyurethane, polyether-amide copolymer, and styrene-ethylene, butylene copolymer. Furthermore, the properties of such polymers and copolymers may be further enhanced by the addition of various flow modifiers and other additives well known to those skilled in the art.

Many of these polymers are difficult if not impossible to run at high speed throughputs on existing equipment, such as meltblown equipment, due to the high viscosities of the polymers which can cause zippering of the die at increased pressures. Examples of such polymers include PET polyesters, styrene-ethylene, butylene copolymers, and polyetherester copolymers. As demonstrated by the examples below, these polymers can be extruded using the process and apparatus of the present invention.

The reservoir 12 generally includes means for melting the polymer resin and maintaining the resin in the molten state. Typical resins melt at temperatures in the range of 149 to 260 degrees C. Therefore, the reservoir must be able to maintain resin temperatures to at least within this range. A pump 14 pumps the molten resin from the reservoir 12 to one or more fiber forming dies generally indicated at 16. The apparatus 10 includes a source of pressurized air 18 for operating an on/off control means discussed below and a source of fiberization fluid 20 to fiberize the molten resin as discussed below. Note that a single die 16 or a multiple die assembly, as in FIGS. 3 and 4, may be used to form fibers and nonwoven materials according to the present invention.

The fibers 22 emanating from the die 16 are collected on a receiver assembly such as a continuous wire forming belt 24 in the form of a web 26. The receiver assembly can include means 27 for producing a vacuum beneath the receiving portion of the belt 24 to effectively hold the web 26 to the belt surface and affect the density of the resultant nonwoven web 26. The receiving surface of the belt 24 is spaced at a predetermined distance A' from the die 16. The formed web 26 may be collected on a wind-up roller 28. Alternatively, the web 26 may be further processed downstream from the formation process. Generally, the forming distance A' is between about 7 and 100 centimeters.

Figure 2:
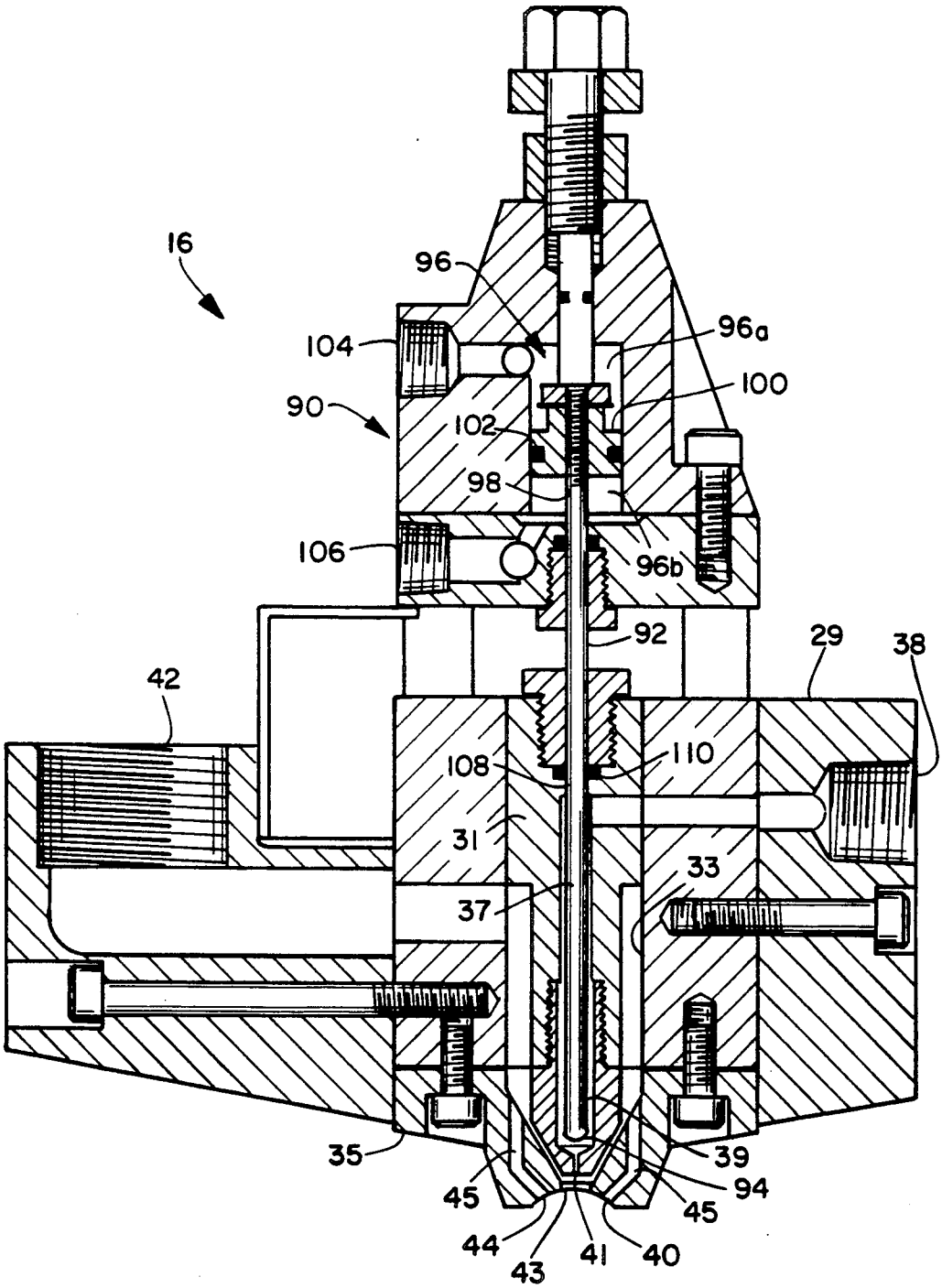
FIG. 2 is a cross-sectional view of the die constructed in accordance with the present invention.
Figure 3:
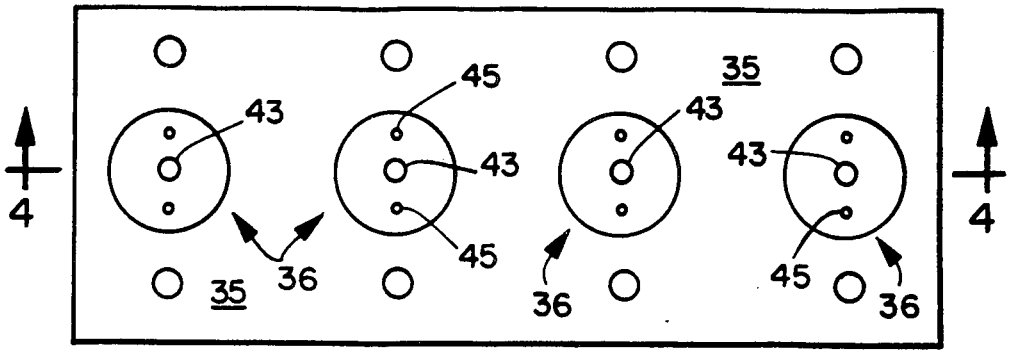
FIG. 3 is a top plan view of a die plate constructed in accordance with the present invention.
Figure 4:
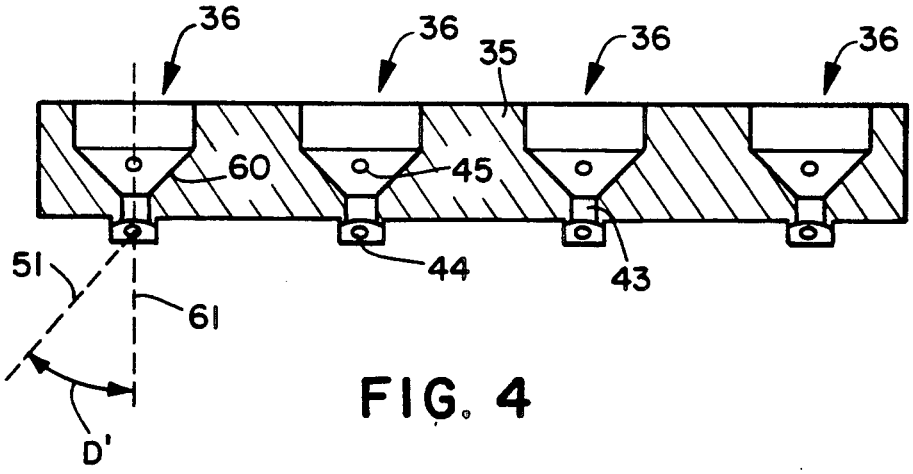
FIG. 4 is a cross-sectional view taken substantially along lines 4—4 of FIG. 3.

Referring to FIG. 2, the fiber forming die 16 in its simplest terms can be viewed as having a main housing 29 for receiving a die assembly including a resin nozzle 31 which is fitted within an air forming chamber 33 and capped with an air plate 35. The air plate 35 may include a plurality of openings for being seated over a plurality of nozzles. FIGS. 3 and 4 show four assemblies 36 in alignment. Alternatively, the assemblies may be aligned in a plurality of rows or staggered to increase the number of openings per unit width. The resin nozzle 31 is in turn fitted with a retractable plunger assembly 37 (a part of the on/off control means) which will permit interruption of the resin flow and cleaning of the nozzle orifice. The die 16 is adapted to receive supplies of both air and molten resin. The air is separately used to operate the retractable plunger assembly 37 and to draw and attenuate the molten resin into fibers as will be explained in more detail below.

Referring to FIG. 2, in tracing the flow of the molten resin from entry to exit of the die 16, the molten resin first enters the main housing 29 of the die 16, through the resin inlet port 38 which leads to the interior of the nozzle 31 located within the die 16. The nozzle 31 contains a resin chamber or main flow body 39 which houses and surrounds the hydraulically actuated plunger assembly 37. Consequently, the resin inlet port 38 and main flow body 39 are in fluid communication with one another. As the molten resin enters the main flow body 39 it fills and pressurizes the chamber. The molten resin is then released from the chamber through a resin fluid capillary 40 to form fibers via a resin outlet orifice 41 located within the air plate assembly 35. Initially, the plunger assembly 37 is seated against the base of the resin outlet orifice 41 thereby preventing release of the molten resin. When the plunger 37 is retracted and therefore unseated from the resin outlet orifice 41, the resin is then permitted to escape from the main flow body 39 and thus begin the formation of the fibers 22.

To fiberize and attenuate the resin exiting the resin outlet orifice 41, fiberization/attenuation air or other fluid is used to surround and draw the resin into fibers 22. Consequently, the die means 16 is equipped with primary and, if desired, secondary fiberization means for drawing and attenuating the fibers 22.

Air or another fluid fiberization source enters the die 16 through a fluid inlet port 42. As can be seen from FIG. 2, the fluid inlet port 42 is in fluid communication with the air forming chamber 33 which is formed by the space between the interior of the main die housing 29/air plate 35 of the die 16 and the exterior of the nozzle 31. The air forming chamber 33 surrounds at least the lower portion of the nozzle 31 and extends into the air plate assembly 35 where it terminates in an annular fluid outlet port 43. The fluid outlet port 43 typically has a diameter ranging from 3.0 to 5.0 millimeters. It is this fluid outlet port 43 which forms the primary means for attenuating and fiberizing the fibers 22. As the fluid outlet port 43 is reduced in diameter the fiberization/attenuation air is increased in velocity causing the fibers 22 to be attenuated more severely.

To further attenuate and fiberize the molten fibers 22, a secondary fiberization means may also be used. Referring to FIGS. 2 and 3, the air plate assembly 35 may be fitted with secondary fluid outlet ports 44 spaced radially and axially outward from the first or primary fluid outlet port 43 to create a plurality of secondary fluid streams which impinge upon and further fiberize the molten resin into fibers. These secondary fluid outlet ports 44 are in fluid communication with the air supply 20 via fluid channels 45 which connect the secondary fluid outlet ports 44 with the air forming chamber 33. Alternatively, and not shown, the secondary fluid outlet ports 44 may be connected to an independent pressurized fluid source so the type and/or pressure of the fluid emanating therefrom may be controlled independently of the primary fiberization fluid. Important to proper fiber and web formation is the balance between the formation of the fibers and their subsequent attenuation. Thus the design and interaction between the nozzle 31 with its resin outlet 41 and the primary and secondary fiberization fluid streams will be set forth in yet further detail.

Figure 5:
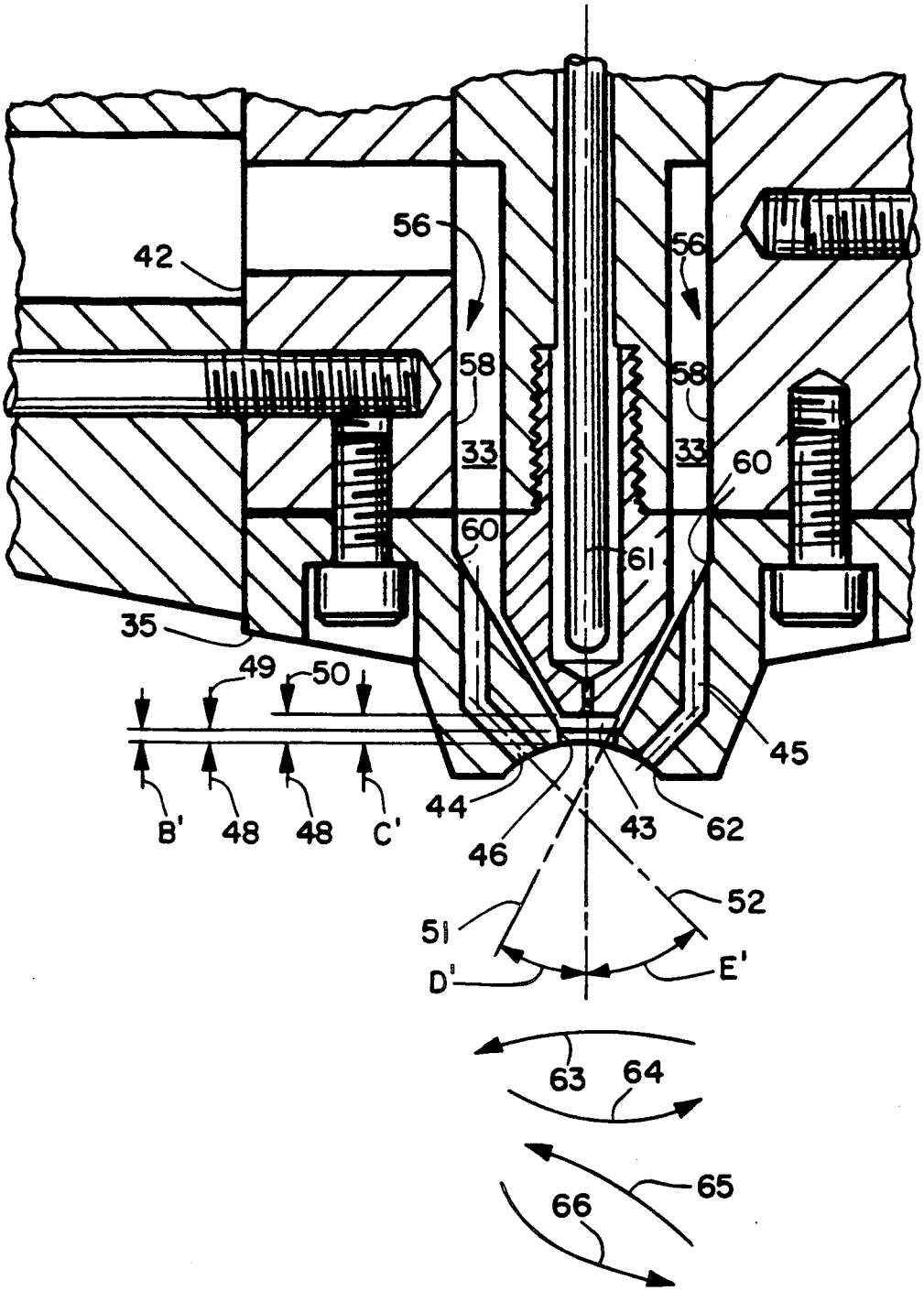
FIG. 5 is an enlarged fragmentary cross-sectional view of the nozzle within the die assembly.

As shown in more detail in FIG. 5 and in conjunction with FIG. 2, the resin outlet orifice 41 and annular fluid outlet port 43 come together directly above an annular wall 46 located in the air plate 35 of the die 16. The height of the annular wall 46 is defined by the distance B' between lines 48 and 49. This distance B' is currently limited by machining capabilities; however, the height B' of annular wall 46 is preferably less than 0.5 millimeters. If this height becomes excessively large, molten resin emanating from the resin outlet 41 will collect on the annular wall 46, thus causing large droplets of molten resin to be conveyed onto the formed web 26. These large droplets are called "shot" and may or may not be desirable depending upon the end use of the fibers/nonwoven web.

Because the resin outlet orifice 41 and fluid outlet port 43 come together directly above the annular wall 46, the nozzle 31 and thus the resin outlet orifice 41 can be changed relative to the air plate 35 to vary the amount of recess within the die 16. This distance C' is measured between the end of the resin outlet orifice 41 (line 50) and the bottom of the annular wall 46 (line 48).

By adjusting this distance C', the effects of the air flowing from fluid outlet port 43 can be varied to fine tune the fiberization of the molten resin. Preferably, the recess distance C' is between 0 and 5 millimeters, although the distance depends upon air flow requirements, polymer viscosity and various other factors which in combination result in the effective control and fiberization of the molten resin. At 0.0 millimeters or no recess the end of the nozzle, i.e., the resin outlet orifice 41, and the fluid outlet port 43 lie substantially in the same plane defined by the exterior surface of the air plate portion 35 of the die housing 29. This same plane would also include line 48 shown in FIG. 5. Generally, as the distance C' is decreased, the air emanating from the fluid outlet port 43 is at a higher velocity causing the resin emanating from the resin outlet orifice 41 to be attenuated more severely. Conversely, as the distance C' is increased, the air emanating from the fluid outlet port 43 is at a lower velocity causing the resin emanating from the resin outlet orifice 41 to be attenuated less severely. Also note that in certain instances it may be desirable to extend the nozzle 31 beyond the plane defined by the exterior surface of the die housing 29.

Referring to FIGS. 2 and 5, air is fed to the fluid outlet port 43 via the inlet port 42 in the side of the main housing 29 in die 16. The inlet port 42 directs the air into the air forming chamber 33 which surrounds the nozzle 31 and which is in communication with the fluid outlet port 43 in the air plate 35. The air forming chamber 33 has a cavity surface generally shown at 56. The cavity surface 56 has a substantially cylindrical portion 58 having a substantially annular shape when viewed in cross section and a second frustoconical portion 60 located within the air plate 35. Surface 60 is inclined at what is termed the primary fluid flow angle defined by angle D' in FIGS. 4 and 5. This is the angle at which the primary fiberization fluid is directed at the flow of molten resin which is traveling along first axis 61. The primary fluid flow angle D' is the angle between the vertical or first axis 61 of the nozzle 31 and a line 51 tangent to the surface of the frustoconical portion 60. Generally, the primary fluid flow angle D' should be between about 15 and 60 degrees. Also note that this first axis 61 defines the initial flow path of the molten resin as it exits the resin outlet orifice 41.

Referring to FIGS. 2 through 5, the air plate assembly 35 may be equipped with secondary fluid outlet ports 44 spaced radially and axially outward from the first or primary fluid outlet port 43 to create a plurality of secondary fluid streams which impinge upon and further fiberize the molten resin into fibers. These secondary fluid outlet ports 44 are in fluid communication with the air supply 20 via fluid channels 45 which connect the secondary fluid outlet ports 44 with the air forming chamber 33. Alternatively, and not shown, the secondary fluid outlet ports 44 may be connected to an independent fluid source so the type and/or pressure of the fluid emanating therefrom may be controlled independently of the primary fiberization source. Note too that the secondary fluid outlet ports 44 may have round or other shaped cross-sections of varying dimensions to produce different fiber forming effects.

The secondary fluid outlet ports 44 are angled radially inward towards the longitudinal axis 61 of the nozzle 31 so that the secondary fiberization fluid impinges upon the preliminarily formed fibers 22 at a predetermined angle. This angle is called the secondary fluid flow angle E' and is measured as the interior angle between the first axis of the resin flow (also the longitudinal axis 61 of nozzle 31) and a line 52 tangent to any one of the fluid streams emanating from the secondary fluid outlet ports 44. See FIG. 5. This angle E' may be varied between 1 and 45 degrees.

The concave bottom surface 62 of the air plate 35 in combination with the primary and secondary fiberization fluid flows provides a confined fiberization area wherein the primary fiberization fluid through outlet port 43 contacts and substantially surrounds the flow of resin from resin outlet orifice 41. Next, the secondary fiberization fluid impinges upon the preliminarily formed fibers. Upon exiting the die, the fiberization air exiting the primary and secondary fluid outlet ports 43 and 44 behaves as a freely expanding jet. A very high level of turbulence is created with this type of jet expansion which causes the molten resin stream to be pulled and drawn in random directions, thereby attenuating and fiberizing the molten resin stream to a very high degree. The secondary fiberization streams impinge upon the spread of fibers formed by the primary fiberization fluid flow and at the point of collision of the two flows the fiberization fluid is redirected to produce a non-circular expanding jet as shown by the arrows 63, 64, 65 and 66 in FIG. 5. This type of turbulent fiberization process is similar to the meltblowing process which is common within the industry. In contrast, however, the process and apparatus of the present invention allows throughputs on a per-hole basis which are as much as 50 times those compared with current meltblown equipment and techniques. With continuous filament fiberization processes, such as spunbonding, the fiberization air is controlled in the laminar region. This causes the molten resin to be attenuated in a controlled environment. The advantages of the turbulent fiberization process is that a higher degree of attenuation can be achieved than is possible through the laminar, continuous filament process. This higher degree of attenuation can result in the formation of smaller size fibers.

Figure 6:
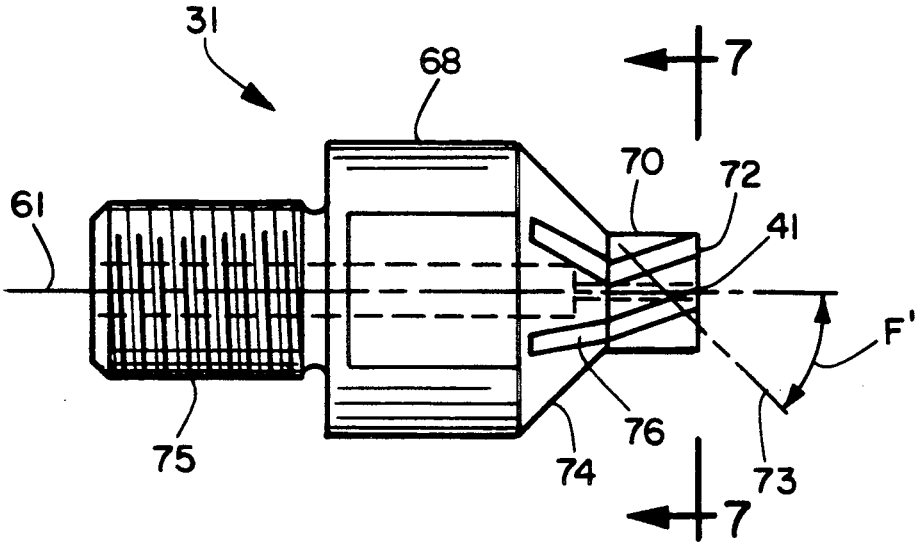
FIG. 6 is a side view of a nozzle constructed in accordance with the present invention.
Figure 7:
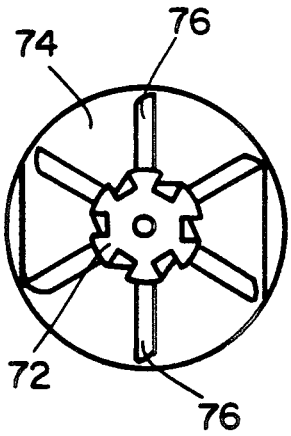
FIG. 7 is a plan view taken substantially along lines 7—7 of FIG. 6.

Besides variations in the primary and secondary fiberization fluid flow about the fibers, variations can also be made in the nozzle 31 to affect fiber formation. As shown in more detail in FIGS. 6 and 7, a first embodiment of the nozzle 31 includes a first axial portion 68 having a first predetermined radial extent and with an axial end portion 70 including a land surface 72, the land surface 72 including the resin outlet orifice 41. The axial end portion 70 has a second predetermined radial extent which is less than the first radial extent of the first axial portion 68. The nozzle portion 31 further includes a tapered axial portion 74 extending between the first axial portion 68 and the axial end portion 70. The angle of the tapered axial portion 74 is defined as the interior angle F' between the longitudinal axis 61 of the nozzle 31 and a line 73 tangent to the surface of the frustoconical portion 74. Generally, this frustoconical angle F' is between about 15 and 60 degrees. In addition, the nozzle 31 may include a threaded end portion 75 for connecting the nozzle 31 into the main housing 29 of the die 16.

The nozzle 31 may include further means for directing the flow of the fluid thereabout. This fluid flow directing means may comprise a plurality of flutes 76 on the outer surface of the nozzle 31. The flutes 76 may extend over the tapered axial portion 74, the axial end portion 70, and into the land surface 72.

Figure 8:
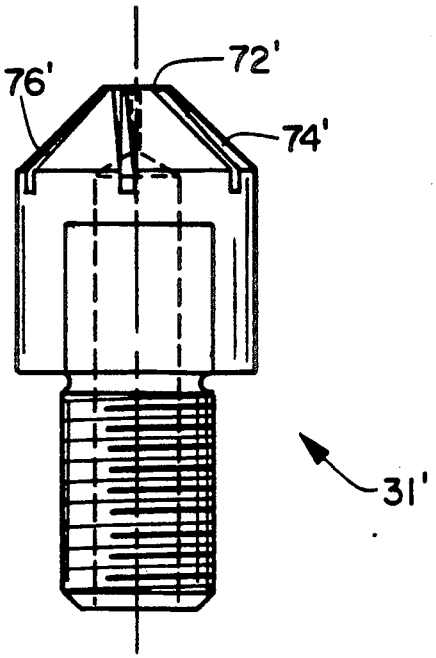
FIG. 8 is a side view of another nozzle constructed in accordance with the present invention.
Figure 9:
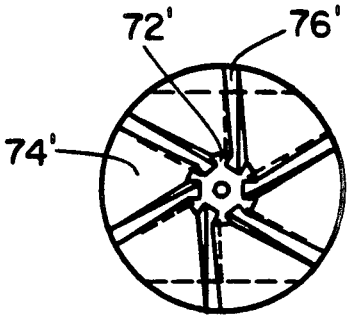
FIG. 9 is an end view of the nozzle shown in FIG. 8.

In a second embodiment of the nozzle portion of the present invention shown in FIGS. 8 and 9 wherein like structures are shown by primed numbers, the nozzle 31' does not include an axial end portion 70. Rather, the land surface 72' is directly adjacent the distal edge of the tapered axial portion 74'. As shown in both the embodiments of FIGS. 7 and 9, the flutes 76, 76' extend into the land surfaces 72, 72'.

The fiberization air source 20 provides a primary air flow supply entering into the die through the fluid inlet 42 shown in FIG. 2. The inner cavity 33 provides a balancing channel for distributing the incoming air about the nozzle 31. The air balances around the nozzle 31 and is then directed towards the fluid outlet port 43 of the air flow channel defined within the cavity 33 due to the air pressure utilized in the system. This primary air flows over the flutes 76, 76' that have been cut into the outside diameter of the nozzle on compound angles thereby causing the fiberization air to spiral about and attenuate the newly-formed fibers 22.

Figure 10:
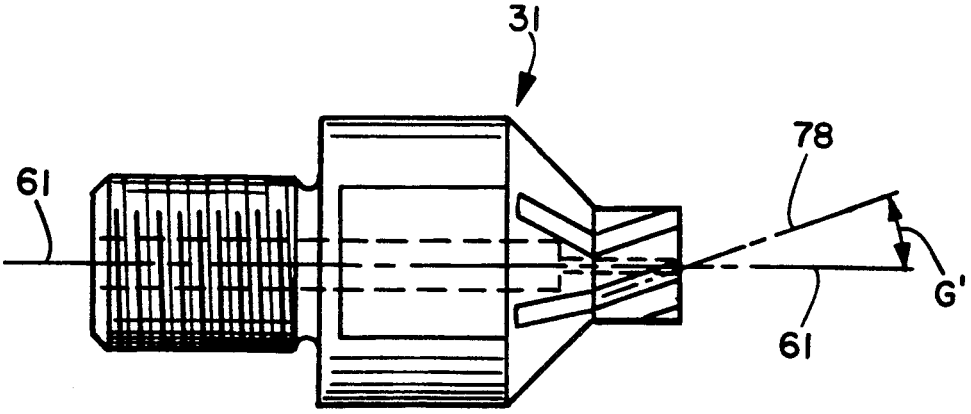
FIG. 10 is another side view of the nozzle of FIG. 6 showing the flute spiral angle G'.

The flute spiral angle G' around the nozzle tip is the interior angle measured between the first axis 61 of the nozzle 31 and a line 78 parallel to the longitudinal axis of one of the flutes 76, shown as angle G' in FIG. 10. The flute spiral angle G' should generally be between about 20 and 45 degrees. This spiral angle determines the rotational and centrifugal force of the fluid flow acting on the molten resin stream emitted from the resin outlet orifice 41.

Figure 11:
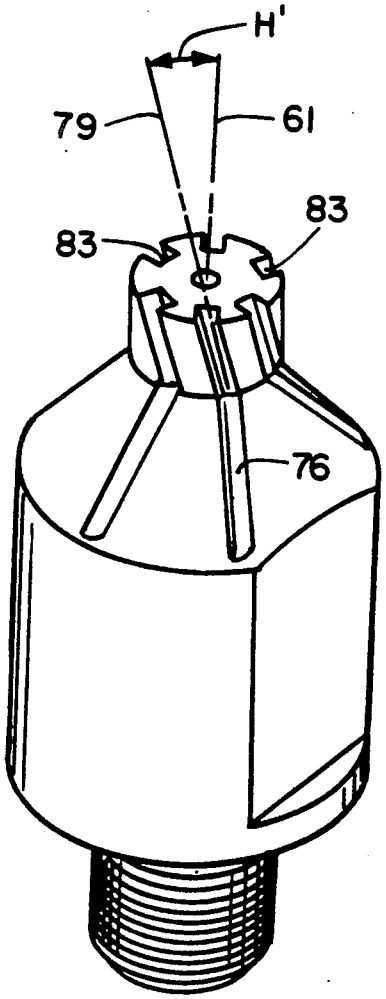
FIG. 11 is a perspective view of the nozzle of FIG. 6 showing the flute attack angle H'.

The flute attack angle H' determines how quickly the air contacts the resin stream. This angle is the angle measured between the longitudinal axis 61 of the nozzle 31 and a line 79 parallel to the interior surface 83 of one of the flutes 76. See FIG. 11. The attack angle H' in conjunction with the angle of the frustoconical portion 60 of the air forming chamber 33 determines the collision location of the primary air flow as it flows over the flutes 76 and contacts the stream of molten resin which exits the resin outlet orifice 41. The flute attack angle H' should generally range between about 7 and 60 degrees.

Figure 13:
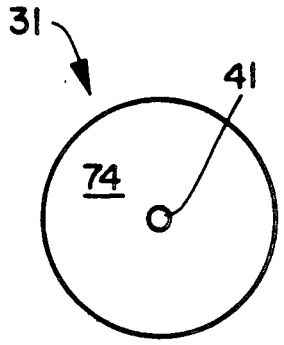
FIG. 13 is a plan view taken substantially along lines 13—13 of FIG. 12.
Figure 12:
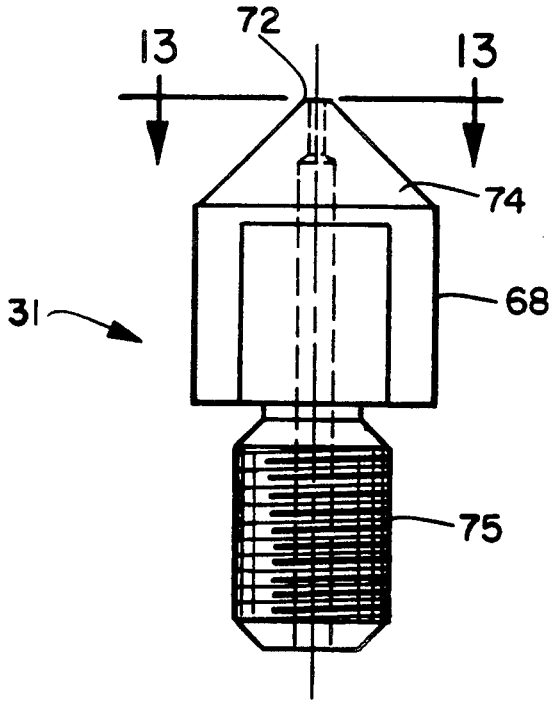
FIG. 12 is a side view of yet another embodiment of a nozzle constructed in accordance with the present invention.

In a third embodiment of the nozzle shown in FIGS. 12 and 13, the nozzle 31 does not include flutes on the tapered axial portion 74 or on the land surface 72. The absence of the flutes in this third embodiment minimizes rotational forces in the air stream. This may be preferred for certain molten polymers which have relatively low melt strength.

It can be seen that there are many surfaces within the die housing 29 which can be varied to modify the flow characteristics and thus the formation of the fibers 22 created by the present apparatus and process. A particularly advantageous feature of the present invention is the interchangeability of the nozzles 31. By removing the air plate 35, the nozzle 31 can be removed and a new nozzle inserted. As a result, changes in resin and fiber formation can be complemented by changes in nozzles.

Additional versatility is added to the present invention by the fact that it is provided with a means for selectively stopping and starting the flow of resin and thus the formation of fibers. In multi-die configurations such as are shown in FIGS. 3 and 4, it is possible to cycle one, some, or all of the nozzles on and off. As a result, it is possible to interrupt the fiber formation process, thereby creating individual discrete nonwoven webs. In addition, by being able to cycle select nozzles on and off, nonwoven webs can be created with varying basis weight in either or both of the machine-and cross-directions. In in-line processes, such as the formation of personal care products (diapers, sanitary napkins, etc.), it is therefore possible to tailor design specific areas and attributes of the product, as, for example, zoned absorbency. To accomplish this, the apparatus 10 includes on/off control means for selectively stopping and starting resin flow from the resin outlet orifice 41 while simultaneously dislodging resinous debris therefrom.

Referring to FIGS. 2 and 5, the on/off control means includes a pneumatic fixture generally indicated at 90 which is connected to and therefore forms a part of the main die housing 29. Extending from the pneumatic fixture 90 into the main flow body 39 is a plunger assembly or reciprocating stem 92 having a distal tip 94 located above the resin flow capillary 40. The stem 92 has an unseated condition, as shown in FIGS. 2 and 5, wherein the tip 94 is retracted into the main flow body 39 and spaced from the capillary 40 and a seated condition (not shown) wherein the stem 92 is reciprocated to seat the tip 94 against the capillary 40. By seating the stem 92, a hydrostatic pressure is created in the capillary 40 which dislodges any debris located therein and restricts flow of molten resin from the resin flow outlet 41.

The pneumatic fixture 90 includes a pneumatic chamber 96, including an upper chamber **96*a* and a lower chamber 96*b*, shown in FIG. 2. The stem 92 includes an end portion 98 extending into the pneumatic chamber 96. The end portion 98 of the stem 92 has a piston 100 mounted thereon and fitted with seals 102 to contact the walls of chamber 96 to form the upper and lower chambers 96*a* and 96*b*, respectively. The chamber 96 includes a pair of hydraulic fluid ports 104, 106 opening into the pneumatic chamber 96 for supplying varying fluid pressure on each side of the piston 100 to reciprocate the piston 100 within the pneumatic chamber 96 thereby reciprocating the stem 92** between the seated (off) and unseated (on) conditions.

The main flow body 39 includes a stem port 108 with the stem 92 extending through the stem port 108. The die 16 includes a high temperature resistant dynamic seal 110 for allowing sliding engagement while perfecting a seal between the stem 92 and the stem port 108 to prevent the passage of molten resin through the port 108. The seal 110 can be U-shaped in cross-section so as to expand into the space between the stem 92 and the wall of the port 108 upon pressure applied by the incoming polymer resin. Thus, the seal 110 provides a separation between the molten material and the outside environment under molten material pressure conditions. The seal mechanism should provide a positive seal at temperatures up to 350 degrees C.

Operation of the on/off mechanism involves selectively pressurizing either the upper chamber **96*a* or the lower chamber 96*b*. To turn the mechanism on and start the flow of molten resin from resin outlet orifice 41, the pressure from upper chamber 96*a* is relieved through fluid port 104 and pressurized air is fed into lower chamber 96*b* via fluid port 106. As a result of the pressure imbalance on either side of the piston 100, the piston 100 moves further into the upper chamber 96*a* unseating the tip 94 of the stem 92 from the capillary 40 and thereby allowing the release of the molten resin from the main flow body 39 through resin outlet orifice 41. To turn off the mechanism and interrupt the flow of molten resin the above procedure is reversed. Namely, the pressure from the lower chamber 96*b* is decreased and the pressure in the upper chamber 96*a* is increased, again causing a pressure imbalance which forces the tip 94 of stem 92 to seat against the capillary 40 and cut off the flow of molten resin. Additionally, this action will create a sufficient hydrostatic pressure within capillary 40 to dislodge any debris located therein. Alternatively, it should be appreciated that the pneumatic fixture 90 may be modified by, as an example, adding a mechanical spring (not shown) within one of the chambers 96***a* or 96*b* to further act upon the piston 100 to maintain the stem 92 in either a seated or unseated condition absent the use of air pressure in the opposite chamber. Thus, the present invention can be utilized under varying conditions to provide a very useful range of throughputs, significantly higher than meltblowing processes.

The present invention further provides a novel process for forming the nonwoven web 16, generally including the steps of supplying a quantity of melted fiber-forming thermoplastic resin, pumping the resin to the fiber-forming die 16, forming a discrete flow of resin to flow from the die 16, flowing a stream of fiberization fluid, such as air, in contact and substantially surrounding the formed flow or resin, and collecting the formed fibers at a predetermined distance A' from the die 16. More specifically, the flow of fiberization fluid is contained completely about the resin for a predetermined distance, the distance being called the die recess distance C' which is the distance between lines 48 and 50 in FIG. 5. This distance can be varied by recessing the outlet orifice from the primary air opening 43.

The method further includes the step of balancing the fluid flow from the fluid inlet port 42 about the nozzle 31 within the die 16 in the air forming chamber 33. The flow of fluid is directed about the nozzle 31 by flowing the fluid over the flutes 76 formed on the exterior of the nozzle 31. The spread of the fibers is directed and further fiberized by forming the secondary fiberization fluid flow including at least two fluid streams impinging on the fibers formed by the substantially surrounding primary air flow and colliding the fluid streams to form a non-circular expanding jet as shown in FIG. 5 by arrows 63 through 66. The secondary fiberization fluid, flowing from the two outlet orifices 44 on opposite sides of the surrounding fluid, flows at an angle towards the surrounding fluid flow, defined by angle E' in FIG. 5.

The process further includes the step of selectively stopping the flow of resin from the resin outlet orifice 41. To stop the resin flow, the stem 92 is reciprocated so that the distal tip 94 of the stem 92 seats against the surface of the resin outlet capillary 40 to stop the resin flow and unseats the distal tip 94 from the resin outlet capillary 40 to unstop the resin flow. The seating of the distal tip 94 creates a hydrostatic pressure in the capillary 40 to dislodge debris from the capillary 40 and the resin outlet orifice 41. The stem 92 reciprocates by pneumatic actuation of the piston 100 connected to the stem 92 disposed within the pneumatic chamber 96 to seat and unseat the distal tip 94. The stem 92 can be reciprocated with short or long strokes.

In operation, the resin outlet orifice 41 has a preferred diameter of between 0.5 and 1.0 millimeters, although trials have shown effective fiberization utilizing a polymer orifice diameter of up to 3 millimeters. The nozzle recess C' has been varied between 0 and 5 millimeters with resulting effective fiberization. The nozzle temperature has been varied between 138 and 330 degrees C. Tests have shown an effective air flow of 56 to 1558 standard liters per minute per nozzle with resulting effective fiberization. Nozzle air pressure has been varied between 6.9 and 172 kPa with some trials utilizing pressures as high as 317 kPa. Fiberization air temperatures have been varied between 137 and 343 degrees C. depending on the polymer utilized. A forming distance A' between the nozzle tip and the landing area of the receiving belt has been varied between 15 and 64 centimeters although some trials have been successful utilizing a distance as low as 7.5 centimeters or as high as 102 centimeters. Polymer throughput has been varied between 0.76 and 38 grams per minute per nozzle although other trials have achieved throughputs up to 151 grams per minute per nozzle and as low as 0.1 grams per minute per nozzle. Polymers which can be fiberized with the present invention include, but are not limited to, polypropylene, polyethylene, polybutylene, PET polyester, PETG copolyester, PBT polyester, ethylene vinyl acetate copolymer, polyurethane, polyetherester copolymers, and styrene/ethylene-butylene copolymers.

To demonstrate the functional attributes and properties of the apparatus and products produced by the present invention, a series of experiments, as presented below, were run using an apparatus of the type shown schematically in FIG. 1 and including a general die tip assembly such as is shown in FIG. 2. In all the examples, structurally both the nozzle tip geometry and the air plate geometry can be varied to change the characteristics of the resultant fiber formation. In addition, both the nozzle recess distance and the forming distance between the die and the receiver can be varied to affect the fiber formation and the attributes of the resultant nonwoven web. Depending upon the particular polymer used, other factors can be varied to affect fiber formation including the melt temperature of the polymer, the polymer throughput rate in grams per hole (nozzle) per minute, air flow in standard liters per minute per nozzle, and lastly, air temperature of the forming air. In most cases, the resin was extruded through a four-nozzle head assembly. However, in Examples VIII, IX, XIII and XIV, a single-nozzle assembly was used; in Example IV an eight nozzle assembly was used, and in Example XII an eighteen nozzle assembly was used. All data are given on a per hole (nozzle) basis.

EXAMPLE I

A PET polyester manufactured by Eastman Chemical Products, Inc. and designated No. 9028 was extruded at a melt temperature of 287 degrees C. at a throughput of 3.1 grams per hole per minute resulting in a melt pressure of 455 kPa. The fiberization fluid was air at a flow rate of 177 standard liters per minute per nozzle with an air temperature of 293 degrees C.The nozzles located within the die housing had a first axial portion diameter of 12 millimeters, a cylindrical end portion diameter of 5 millimeters, a resin outlet orifice diameter of 1 millimeter with the angle of the frustoconical section being 45 degrees. The nozzles included six flutes having a flute spiral angle of 20 degrees and a flute attack angle of 7 degrees. Air flow geometry included a primary air opening diameter of 5 millimeters, a primary fluid flow angle of 45 degrees and two secondary air orifices both having a 1.5 millimeter diameter with a 180 degree separation. The secondary fluid flow angle was 45 degrees. The nozzle recess distance was 2 millimeters and the forming distance between the die and the receiver was 38.10 centimeters. Under the above conditions, the average fiber diameter was 15.5 microns, the web formed from the extruded fibers had a density of approximately 0.061 grams per cubic centimeter and the average shot size using an optical microscope was 0.015 square millimeters.

EXAMPLE II

A PETG copolyester manufactured by Eastman Chemical Products, Inc. and designated Kodar 6763 was extruded at a melt temperature of 287 degrees C. at a throughput of 7.4 grams per hole per minute, resulting in a melt pressure of 896 kPa. The fiberization fluid was air at a flow rate of 127 standard liters per minute per nozzle with an air temperature of 283 degrees C.The nozzles located within the die housing had a first axial portion diameter of 12 millimeters, a cylindrical end portion diameter of 5 millimeters, a resin outlet orifice diameter of 1 millimeter with the angle of the frustoconical section being 45 degrees. The nozzles included six flutes having a flute spiral angle of 20 degrees and a flute attack angle of 7 degrees. Air flow geometry included a primary air opening diameter of 5 millimeters, a primary fluid flow angle of 45 degrees and two secondary air orifices both having a 2.0 millimeter diameter with a 180 degree separation. The secondary fluid flow angle was 45 degrees. The nozzle recess distance was 2 millimeters and the forming distance between the die and the receiver was 58 centimeters. Under the above conditions, the average fiber diameter was 24.9 microns, the web formed from the extruded fibers had a density of approximately 0.050 grams per cubic centimeter and the average shot size using an optical microscope was 0.0076 square millimeters.

EXAMPLE III

Polyurethane manufactured by B. F. Goodrich and designated Estane 5740x732 was extruded at a melt temperature of 216 degrees C. at a throughput of 6.6 grams per hole per minute resulting in a melt pressure of 827 kPa. The fiberization fluid was air at a flow rate of 184 standard liters per minute per nozzle with an air temperature of 232 degrees C.The nozzles located within the die housing had a first axial portion diameter of 12 millimeters, a cylindrical end portion diameter of 5 millimeters, a resin outlet orifice diameter of 1 millimeter with the angle of the frustoconical section being 45 degrees. The nozzles included six flutes having a flute spiral angle of 20 degrees and a flute attack angle of 7 degrees. Air flow geometry included a primary air opening diameter of 5 millimeters, a primary fluid flow angle of 45 degrees and two secondary air orifices both having a 1.5 millimeter diameter with a 180 degree separation. The secondary fluid flow angle was 25 degrees. The nozzle recess distance was 2 millimeters and the forming distance between the die and the receiver was 15 centimeters. Under the above conditions, the average fiber diameter was 24 microns, the web formed from the extruded fibers had a density of approximately 0.150 gm/cm$^3$ and the average shot size using an optical microscope was 0.0098 square millimeters.

EXAMPLE IV

A styrene-ethylene-butylene-styrene copolymer manufactured by The Shell Chemical Company and designated Kraton G-2740X was extruded at a melt temperature of 238 degrees C. at a throughput of 3.7 grams per hole per minute resulting in a melt pressure of 586 kPa. The fiberization fluid was air at a flow rate of 120 standard liters per minute per nozzle with an air temperature of 263 degrees C. The nozzles located within the die housing had a first axial portion diameter of 12 millimeters, a cylindrical end portion diameter of 4 millimeters, a resin outlet orifice diameter of 1 millimeter with the angle of the frustoconical section being 45 degrees. The nozzles included six flutes having a flute spiral angle of 20 degrees and a flute attack angle of 45 degrees. Air flow geometry included a primary air opening diameter of 4 millimeters, a primary fluid flow angle of 45 degrees and three secondary air orifices on each side of the primary air openings, all having a 1.5 millimeter diameter. The secondary fluid flow angles were each 45 degrees. The nozzle recess distance was 2 millimeters and the forming distance between the die and the receiver was 23 centimeters. Under the above conditions, the average fiber diameter was 86 microns, the web formed from the extruded fibers had a density of approximately 0.161 gm/cm$^3$ and the average shot size using an optical microscope was 0.025 square millimeters.

EXAMPLE V

A polymer containing by weight 83% Dow Chemical Aspun® 6814 polyethylene, 12% Allied Chemical AC-9 polyethylene, 4% blue polyethylene coloring and 1% wetting agent was extruded at a melt temperature of 232 degrees C. at a throughput of 18.9 grams per hole per minute using a melt pressure of 2758 kPa. The fiberization fluid was air at a flow rate of 348 standard liters per minute per nozzle with an air temperature of 210 degrees C.The nozzles located within the die housing had a first axial portion diameter of 12 millimeters, a cylindrical end portion diameter of 5 millimeters, a polymer exit orifice diameter of 1 millimeter with the angle of the frustoconical section being 45 degrees. The nozzles included six flutes having a flute spiral angle of 20 degrees and a flute attack angle of 7 degrees. Air flow geometry included a primary air opening diameter of 5 millimeters, a primary fluid flow angle of 45 degrees and two secondary air orifices with 180 degrees separation, both having a 2 millimeter diameter. The secondary fluid flow angle was 45 degrees. The nozzle recess distance was 4 millimeters and the forming distance between the die and the receiver was 54 centimeters. Under the above conditions, the average fiber diameter was 21 microns, the web formed from the extruded fibers had a density of approximately 0.072 gm/cm$^3$ and the average shot size using an optical microscope was 0.24 square millimeters.

EXAMPLE VI

A blend of 93.5% Himont Profax PF-015 polypropylene, 4.0% Standridge Color Corp. 5834 blue polypropylene color concentrate and 2.5% wetting agent was extruded at a melt temperature of 235 degrees C. at a throughput of 18.9 grams per hole per minute resulting in a melt pressure of 1172 kPa. The fiberization fluid was air at a flow rate of 266 standard liters per minute per nozzle with an air temperature of 235 degrees C.The nozzles located within the die housing had a first axial portion diameter of 12 millimeters, a cylindrical end portion diameter of 5 millimeters, a resin outlet orifice diameter of 1 millimeter with the angle of the frustoconical section being 45 degrees. The nozzles included six flutes having a flute spiral angle of 20 degrees and a flute attack angle of 7 degrees. Air flow geometry included a primary air opening diameter of 4 millimeters, a primary fluid flow angle of 45 degrees ad two 1.5 millimeter diameter secondary air orifices on each side of the primary air openings. The secondary fluid flow angle was 45 degrees. The nozzle recess distance was 2 millimeters and the forming distance between the die and the receiver was 48 centimeters. Under the above conditions, the average fiber diameter was 21 microns, the web formed from the extruded fibers had a density of approximately 0.080 gm/cm$^3$ and the average shot size using an optical microscope was 0.11 square millimeters.

EXAMPLE VII

Profax PF-015 polypropylene was extruded at a melt temperature of 260 degrees C. at a throughput of 2.8 grams per hole per minute resulting in a melt pressure of 103 kPa. The fiberization fluid was air at a flow rate of 545 standard liters per minute per nozzle with an air temperature of 260 degrees C.The nozzles located within the die housing had a first axial portion diameter of 12 millimeters, a cylindrical end portion diameter of 1.25 millimeters and a resin outlet orifice diameter of 1 millimeter with the angle of the frustoconical section being 30 degrees. The nozzles had no flutes. Air flow geometry included a primary air opening diameter of 3 millimeters, a primary fluid flow angle of 30 degrees and three secondary air orifices on each side of the air plate, all having a 1.5 millimeter diameter. The secondary fluid flow angle was 45 degrees. The nozzle recess distance was 0.5 millimeters and the forming distance between the die and the receiver was 48 centimeters. Under the above conditions, the average fiber diameter was 2.3 microns, the web formed from the extruded fibers had a density of approximately 0.069 gm/cm$^3$ and the average shot size using an optical microscope was 0.034 square millimeters.

EXAMPLE VIII

Himont Profax PF-015 polypropylene was extruded at a melt temperature of 260 degrees C. at a throughput of 148 grams per hole per minute resulting in a melt pressure of 1710 kPa. The fiberization fluid was air at a flow rate of 1558 standard liters per minute per nozzle with an air temperature of 260 degrees C.The nozzle located within millimeters, a cylindrical end portion diameter of 5 millimeters, a resin outlet orifice diameter of 1 millimeter with the angle of the frustoconical section being 45 degrees. The nozzle included six flutes having a flute spiral angle of 20 degrees and a flute attack angle of 7 degrees. Air flow geometry included a primary air opening diameter of 5 millimeters, a primary fluid flow angle of 45 degrees and two secondary air orifices both having a 1.5 millimeter diameter with a 180 degree separation. The secondary fluid flow angle was 45 degrees. The nozzle recess distance was 2 millimeters and the forming distance between the die and the receiver was 38 centimeters. Under the above conditions, the average fiber diameter was 30 microns, the web formed from the extruded fibers had a density of approximately 0.069 gm/cm$^3$ and the average shot size using an optical microscope was 0.30 square millimeters.

EXAMPLE IX

Himont Profax PF-015 polypropylene was extruded at a melt temperature of 260 degrees C. at a throughput of 37 grams per hole per minute using a melt pressure of 690 kPa. The fiberization fluid was air at a flow rate of 651 standard liters per minute per nozzle with an air temperature of 260 degrees C.The nozzles located within the die housing had a first axial portion diameter of 12 millimeters, a cylindrical end portion diameter of 5 millimeters, a polymer exit orifice diameter of 1 millimeter with the angle of the frustoconical section being 45 degrees. The nozzles included six flutes having a flute spiral angle of 20 degrees and a flute attack angle of 7 degrees. Air flow geometry included a primary air opening diameter of 5 millimeters, a primary fluid flow angle of 45 degrees and two secondary air orifices both having a 1.5 millimeter diameter with a 180 degree separation. The secondary fluid flow angle was 45 degrees The nozzle recess distance was 2 millimeters and the forming distance between the die and the receiver was 38 centimeters. Under the above conditions, the average fiber diameter was 3.1 microns, the web formed from the extruded fibers had a density of approximately 0.049 gm/cm$^3$ and the average shot size using an optical microscope was 0.078 square millimeters.

EXAMPLE X

Arnitel EM-450 polyetherester copolymer manufactured by Akzo was extruded at a melt temperature of 266 degrees C at a throughput of 2.95 grams per hole per minute resulting in a melt pressure of 869 kPa. The fiberization fluid was air at a flow rate of 404 standard liters per minute per nozzle with an air temperature of 264 degrees C. The nozzles located within the die housing had a first axial portion diameter of 12 millimeters, a cylindrical end portion diameter of 5 millimeters, a resin outlet orifice diameter of 1 millimeter with the angle of the frustoconical section being 45 degrees. The nozzles included six flutes having a flute spiral angle of 20 degrees and a flute attack angle of 7 degrees. Air flow geometry included a primary air opening diameter of 5 millimeters, a primary fluid flow angle of 45 degrees and two secondary air orifices both having a 1.5 millimeter diameter with a 180 degree separation. The secondary fluid flow angle was 25 degrees. The nozzle recess distance was 2 millimeters and the forming distance between the die and the receiver was 24 centimeters. Under the above conditions, the average fiber diameter was 12 microns, the web formed from the extruded fibers had a density of approximately 0.104 gm/cm$^3$ and the average shot size using an optical microscope was 0.058 square millimeters.

EXAMPLE XI

Himont Profax PF-015 polypropylene was extruded at a melt temperature of 260 degrees C. at a throughput of 23 grams per hole per minute resulting in a melt pressure of 1931 kPa. The drawing air was at an air flow rate of 375 standard liters per minute per nozzle with an air temperature of 274 degrees C.The nozzles located within the die housing had a first axial portion diameter of 12 millimeters, a cylindrical end portion diameter of 4 millimeters, a resin outlet orifice diameter of 0.5 millimeters with the angle of the frustoconical section being 45 degrees. The nozzles included six flutes having a flute spiral angle of 20 degrees and a flute attack angle of 7 degrees. Air flow geometry included a primary air opening diameter of 5 millimeters, a primary fluid flow angle of 45 degrees and two secondary air orifices each having a 2 millimeters diameter with a 180 degree separation. The secondary fluid flow angle was 45 degrees. The nozzle recess distance was 2 millimeters and the forming distance between the die and the receiver was 13 centimeters. Under the above conditions, the average fiber diameter was 5.7 microns, the web formed from the extruded fibers had a density of approximately 0.035 gm/cm$^3$ and the average shot size using an optical microscope was 0.079 square millimeters.

EXAMPLE XII

Profax PF-015 polypropylene was extruded at a melt temperature of 260 degrees C. at a throughput of 0.34 grams per hole per minute resulting in a melt pressure of 69 kPa. The fiberization fluid was air at a flow rate of 136 standard liters per minute per nozzle with an air temperature of 304 degrees C.The nozzles located within the die housing had a first axial portion diameter of 12 millimeters, a cylindrical end portion diameter of 1.25 millimeters, a resin outlet orifice diameter of 1 millimeter with the angle of the frustoconical section being 30 degrees. The nozzles had no flutes. Air flow geometry included a primary air opening diameter of 4 millimeters, a primary fluid flow angle of 45 degrees and three secondary air orifices on each side of each resin outlet orifice, all having a 1.5 millimeter diameter. The secondary fluid flow angle was 45 degrees. The nozzle recess distance was 2 millimeters and the forming distance between the die and the receiver was 39 centimeters. Under the above conditions, the average fiber diameter was less than 2.0 microns, the web formed from the extended fibers had a density of approximately 0.039 gm/cm$^3$ and the average shot size using an optical microscope was 0.020 square millimeters.

EXAMPLE XIII

Himont Profax PF-015 polypropylene was extruded at a melt temperature of 260 degrees C. at a throughput of 38.4 grams per hole per minute resulting in a melt pressure of 462 kPa. The fiberization fluid was air at a flow rate of 1104 standard liters per minute per nozzle with an air temperature of 260 degrees C.The nozzle located within the die housing had a first axial portion diameter of 12 millimeters, a cylindrical end portion diameter of 5 millimeters, a resin outlet orifice diameter of 2 millimeters with the angle of the frustoconical section being 45 degrees. The nozzle included six flutes having a flute spiral angle of 20 degrees and a flute attack angle of 7 degrees. Air flow geometry included a primary air opening diameter of 5 millimeters, a primary fluid flow angle of 45 degrees and two secondary air orifices both having a 1.5 millimeter diameter with a 180 degree separation. The secondary fluid flow angle was 45 degrees. The nozzle recess distance was 2 millimeters and the forming distance between the die and the receiver was 38 centimeters. Under the above conditions, the average fiber diameter was 3.3 microns, the web formed from the extruded fibers had a density of approximately 0.095 gm/cm$^3$ and the average shot size using an optical microscope was 0.14 square millimeters.

EXAMPLE XIV

Himont Profax PF-015 polypropylene was extruded at a melt temperature of 260 degrees C. at a throughput of 38.3 grams per hole per minute resulting in a melt pressure of 283 kPa. The fiberization fluid was air at a flow rate of 651 standard liters per minute per nozzle with an air temperature of 260 degrees C.The nozzle located within the die housing had a first axial portion diameter of 12 millimeters, a cylindrical end portion diameter of 5 millimeters, a resin outlet orifice diameter of 3 millimeters with the angle of the frustoconical section being 45 degrees. The nozzle included six flutes having a flute spiral angle of 20 degrees and a flute attack angle of 7 degrees. Air flow geometry included a primary air opening diameter of 5 millimeters, a primary fluid flow angle of 45 degrees and two secondary air orifices both having a 1.5 millimeter diameter with a 180 degree separation. The secondary fluid flow angle was 45 degrees. The nozzle recess distance was 2 millimeters and the forming distance between the die and the receiver was 38 centimeters. Under the above conditions, the average fiber diameter was 3.1 microns, the web formed from the extruded fibers had a density of approximately 0.065 gm/cm$^3$ and the average shot size using an optical microscope was 0.075 square millimeters.

From the foregoing examples, it can be seen that the process and apparatus of the present invention permit the formation of fibers and resultant nonwoven webs from a wide variety of polymers under various conditions. Typical meltblown equipment under the very best of conditions can only process standard polymers at rates of more than 3 grams per hole per minute. With certain polymers, even these throughputs are not possible due to the danger of the meltblown dies zippering. In contrast, the process and the apparatus of the present invention has been shown to be able to process polymers at rates as high as 150 grams per hole per minute. In port, this higher throughput capability is due to the higher melt pressure capability of the nozzle. As spelled out in the working examples, melt pressures up to 2758 kPa can be withstood. Other experiments have shown melt pressures as high as 6900 kPa can be withstood without failure of equipment. This is in contrast to meltblown die tip pressures which are believed to have maximum let pressures of only 2100 kPa. Thus, the present apparatus may be used in single or multiple die configurations which, on a per hole basis, will far exceed current meltblown capabilities. As a result, the apparatus of the present invention may be used in areas where space constraints are critical. In addition, the apparatus may be used to create localized fiber formation thereby permitting the creation of the nonwoven webs having wide variances in their basis weights. Nonwoven webs with variances in their basis weights in excess of 10% have been created by localized increases and/or reductions in fiber formations in either or both of the machine and cross-directions. Consequently, it can be seen that the process and apparatus of the present invention can be applied in a wide variety of applications to enhance current nonwoven forming techniques.

The invention has been described in an illustrative manner, and it is to be understood that the terminology which has been used is intended to be in the nature of words of description rather than of limitation. Obviously, many modifications and variations of the present invention are possible in light of the above teachings. It is, therefore, to be understood that within the scope of the appended claims the invention may be practiced otherwise than as specifically described.

What is claimed is:

1. An apparatus for forming fibers from a fiber-forming resin comprising:

a die housing including a resin chamber for receiving a supply of molten fiber-forming resin, said chamber having a resin outlet orifice in fluid communication therewith for emitting said molten resin in the form of a flow, said flow defining a first axis, and primary fiberization means completely surrounding said resin outlet orifice for drawing said resin into fibers, said primary fiberization means including a fluid outlet port in said die housing completely surrounding said flow of resin from said resin outlet orifice and a primary fiberization fluid emanating from said fluid outlet port for fiberizing said resin to form fibers, said primary fiberization fluid contacting said flow of resin at a primary fluid flow angle of between about 15 and 60 degrees, said angle being measured as an interior angle between the intersection of the first axis of said flow of resin and a line tangent tot he flow of said primary fiberization fluid.

said die housing further including a nozzle located therein and a least partially surrounded by a fiberization fluid chamber which terminates in said fluid outlet port, said nozzle including said resin chamber and said resin outlet orifice, said nozzle having a nozzle exterior surface, said nozzle exterior surface having a plurality of flutes adjacent said resin outlet orifice to direct said primary fiberization fluid.

2. The apparatus of claim 1 whenin nozzle has a flute attack angle of about 7 to degrees.

3. The apparatus of claim 2 wherein said nozzle has a flute spiral angle of about 20 to 45 degrees.

4. The apparatus of claim 1 wherein said nozzle has a frustoconical angle of about 15 to 60 degrees.

5. The apparatus of claim 1 wherein said nozzle exterior surface includes a first axial portion having a first predetermined radial extent and an axial end portion having a land surface including said resin outlet orifice extending therethrough and having a second predetermined radial extent which is less than said first radial extent, said nozzle including a tapered axial portion extending between said first axial portion and said axial end portion, said tapered axial portion including said plurality of flutes, said flutes extending into said land surface.

6. The apparatus of claim 5 wherein said axial end portion includes a substantially cylindrical outer surface including said flutes.

7. An apparatus for forming fibers from a fiber forming resin comprising:

a die housing including a resin chamber for receiving a supply of molten fiber forming resin, said chamber having a resin outlet orifice in fluid communication therewith for emitting said molten resin in the form a flow, said flow defining a first axis, primary fiberization means completely surrounding said resin outlet orifice for drawing said resin into fibers, said primary fiberization means including a fluid outlet port in said die housing completely surrounding said flow of resin from said resin outlet orifice and a primary fiberization fluid emanating from said fluid outlet port for fiberizing said resin to form fibers, said fluid outlet port having a diameter of between about 3 and 5 millimeters, said primary fiberization fluid contacting said flow of resin at a primary fluid flow angle of between about 15 and 60 degrees, said angle being measured as an interior angle between the intersection of the first axis of said flow of resin and a line tangent to the flow of said primary fiberization fluid, and secondary fiberization means located exteriorly from said primary fiberization means comprising a secondary fiberization fluid including at least two fluid streams which each impinge upon said flow of resin at a secondary fluid flow angle of between about 1 and 45 degrees, said angle being measured as an interior angle between the intersection of the first axis of said flow of resin and line tangent to the flow of said fluid stream, said die housing further including a nozzle located therein and at least partially surrounded by a fiberization fluid chamber which terminates in said fluid outlet port, said nozzle including said resin chamber and said resin outlet orifice, said nozzle further including a nozzle exterior surface, said nozzle exterior surface having a plurality of flutes adjacent to said resin outlet orifice to direct said primary fiberization fluid, said nozzle having a fluid attack angle of about 7 to 60 degrees, a flute spiral angle of about 20 to 45 degrees and a frustoconical angle of about 15 to 60 degrees, said nozzle exterior surface including a first axial portion having a first predetermined radial extent and an axial end portion having a land surface including said resin outlet orifice extending therethrough and having a second predetermined radial extent which is less than said first radial extent, said nozzle including a tapered axial portion extending between said first axial portion and said axial end portion, said tapered axial portion including said plurality of flutes, said flutes extending into said land surface.

8. An apparatus for forming individual nonwoven webs in a continuous formation process from a fiber forming resin comprising:

a die housing, at least one die assembly located within said housing, said die assembly including a resin chamber for receiving a supply of molten fiber forming resin, said chamber having a resin outlet orifice in fluid communication therewith for emitting said molten resin in the form of a flow, said flow extending along a first axis, fiberization means for drawing said flow of molten resin into fibers which are collected in the form of nonwoven webs, and on/off control means for selectively interrupting said flow of resin from said resin outlet orifices to form said individual nonwoven webs, said on/off control means including a plunger within said resin chamber, said plunger having a closed position wherein said plunger is in contact with said resin outlet orifice to prevent flow of said molten resin from said orifice and an open position wherein said plunger is retracted from said orifice to allow flow of said molten resin from said orifice, said die housing including a hydraulic chamber, said plunger including an end portion extending into said hydraulic chamber and including a piston mounted thereon, said chamber including hydraulic fluid ports opening into said hydraulic chamber for supplying varying fluid pressure on each side of said piston to reciprocate said piston within said hydraulic chamber to move said plunger between said open and closed positions, said die housing further including a nozzle located therein and at least partially surrounded by a fiberization fluid chamber which terminates in said fluid outlet port, said nozzle including said resin chamber and said resin outlet orifice, said nozzle being removably retained within said die housing, said nozzle having a nozzle exterior surface, said nozzle exterior surface having a plurality of flutes adjacent said resin outlet orifice to direct said primary fiberization fluid, said fiberization means including a fluid outlet port in said die housing completely surrounding said flow of resin from said resin outlet orifice and a primary fiberization fluid emanating from said fluid outlet port for fiberizing said resin to form fibers, said primary fiberization fluid contacting said flow of resin at a primary fluid flow angle of between about 15° and 60°, said angle being measured as an interior angle between the intersection of the first axis of said flow of resin and a line tangent to the flow of said primary fiberization fluid, said fiberization means further including a secondary fiberization fluid including at least two fluid streams which each impinge upon said flow of resin at a secondary fluid flow angle of between about 1° and 45°, said angle being measured as an interior angle between the intersection of the first axis of said flow of resin a nd a line tangent to the flow of said fluid stream.

9. The apparatus of claim 8 wherein said nozzle exterior surface includes a first axial portion having a first predetermined radial extent and an axial end portion having a and surface including said resin outlet orifice extending therethrough and having a second predetermined radial extent which is less than said first radial extent, said nozzle including a tapered axial portion extending between said first axial portion and said axial end portion including said plurality of flutes, said flutes extending into said land surface.

10. The apparatus of claim 9 wherein said end portion includes a substantially cylindrical outer surface including said flutes.

11. The apparatus of claim 10 wherein said nozzle has a flute attack angle of about 7 to 60 degrees.

12. The apparatus of claim 11 wherein said nozzle has a flute spiral angle of about 20 to 45 degrees.

13. The apparatus of claim 12 wherein said nozzle has a frustoconical angle of about 15 to 60 degrees.

* * * * *